US005731041A

United States Patent [19]

Abbott et al.

[11] Patent Number: 5,731,041

[45] Date of Patent: Mar. 24, 1998

[54] METHOD FOR PRODUCING SILICON COATING HAVING HIGH SURFACE AREA

[75] Inventors: Donald C. Abbott, Norton, Mass.; Mohendra S. Bawa, Plano, Tex.

[73] Assignee: Texas Instruments Incorporated, Dallas, Tex.

[21] Appl. No.: 712,096

[22] Filed: Sep. 11, 1996

Related U.S. Application Data

[60] Provisional application No. 60/003,569, Sep. 11, 1995.

[51] Int. Cl.[6] ..... B05D 1/32; B05D 1/08

[52] U.S. Cl. ..... 427/448; 427/452; 427/456; 427/343; 427/352; 427/224; 427/225

[58] Field of Search ..... 427/448, 456, 427/452, 455, 352, 343, 224, 225

[56] References Cited

U.S. PATENT DOCUMENTS

| | | | |
|---|---|---|---|
| 4,181,585 | 1/1980 | Pangborn | 427/448 |
| 4,184,941 | 1/1980 | Cavlin | 427/352 |
| 4,279,709 | 7/1981 | McIntyre et al. | 427/352 |
| 4,331,703 | 5/1982 | Lindmayer | 427/448 |
| 4,392,010 | 7/1983 | Lindmayer | 427/448 |
| 4,666,743 | 5/1987 | Ohta et al. | 427/448 |
| 4,753,849 | 6/1988 | Zohler | 427/352 |
| 4,759,957 | 7/1988 | Eaton et al. | 427/455 |

*Primary Examiner*—Katherine A. Bareford

*Attorney, Agent, or Firm*—W. James Brady, III; Richard L. Donaldson

[57] ABSTRACT

The invention is to a method for producing a high surface substrate. A mask is positioned (31) over a substrate to define a deposition area. Thereafter at least two dissimilar materials are simultaneously deposited (32) through the mask onto the deposition area. Then one of the deposited materials is selectively removed (33) to provide a high surface area deposited substrate.

7 Claims, 4 Drawing Sheets

METHOD FOR PRODUCING SILICON COATING HAVING HIGH SURFACE AREA

This application claims priority under 35 USC §119(e) (1) of provisional application No. 60/003,569 filed Sep. 11, 1995.

FIELD OF THE INVENTION

This invention relates to semiconductor devices, and more particularly to a method for making high surface area substrates.

BACKGROUND OF THE INVENTION

Silicon and silicon coated substrates are useful in forming such devices as silicon based solar cells. Solar cells have been formed of silicon wafers, and substrates covered with a layer of silicon material. Solid silicon substrates are not cost effective. Substrates of silicon deposited on a substrate base usually have an evenly deposited layer of silicon which produce a minimum surface area and are produced by depositing a single material, the silicon.

SUMMARY OF THE INVENTION

The invention is to a method for producing a high surface substrate. A mask is positioned over a substrate to define a deposition area. Thereafter at least two dissimilar materials are simultaneously deposited through the mask onto the deposition area. Then one of the deposited materials is selectively removed to provide a high surface area deposited substrate.

The technical advance represented by the invention as well as the objects thereof will become apparent from the following description of a preferred embodiment of the invention when considered in conjunction with the accompanying drawings, and the novel features set forth in the appended claims.

DESCRIPTION OF A PREFERRED EMBODIMENT

Figure 1:
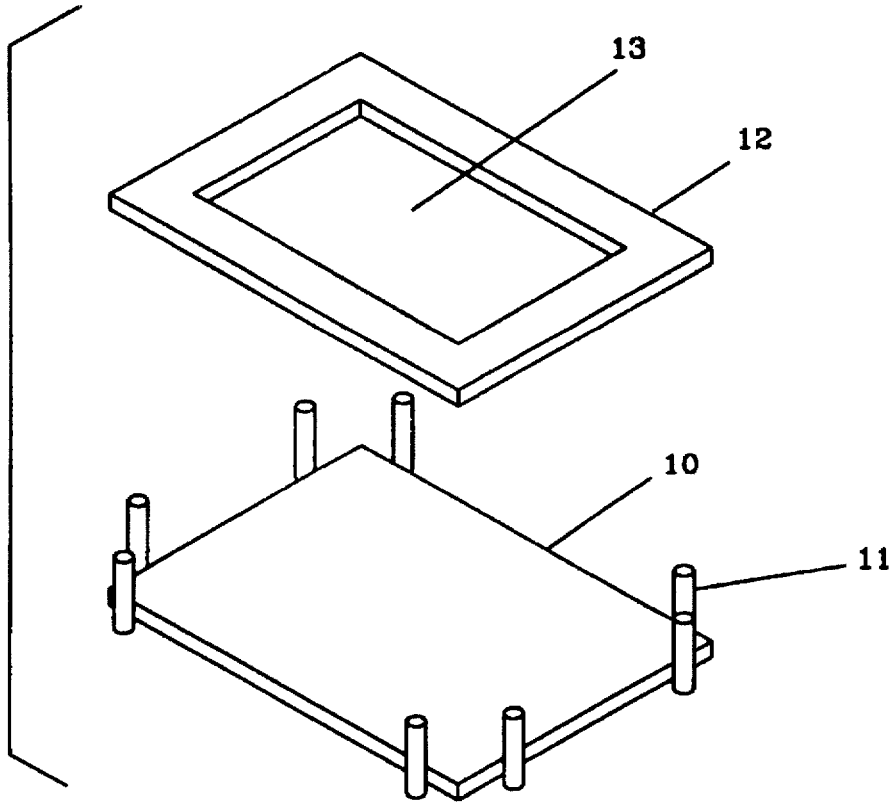
FIG. 1 shows an exploded view of a jig, including the mask, useful in masking off areas where material is not to be deposited, and to precisely expose the area of the deposition.

FIG. 1 shows an exploded view of a jig, including the mask, useful in masking off areas where substrate material is not to be deposited. A substrate 10 is positioned between a plurality of pins 11 used to position and hold the substrate 10 in place. A mask 12 with an aperture therein is shown positioned above substrate 10. The positioning of the mask can be critical where multiple depositions are to be made, one on top of the other.

Figure 2:
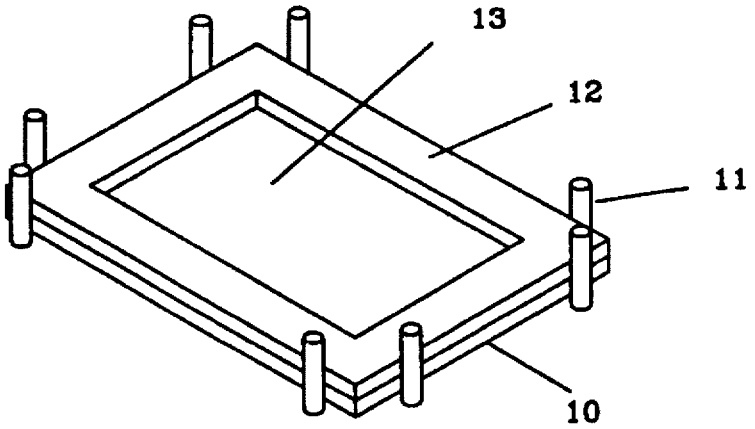
FIG. 2 shows the mask held in position by index pins.

FIG. 2 shows the mask 12 positioned on top of substrate 10 and held in by index pins 11. Index pins 11 assure that the aperture 13 in mask 12 is located in the precise location at which material is to be deposited.

Figure 3:
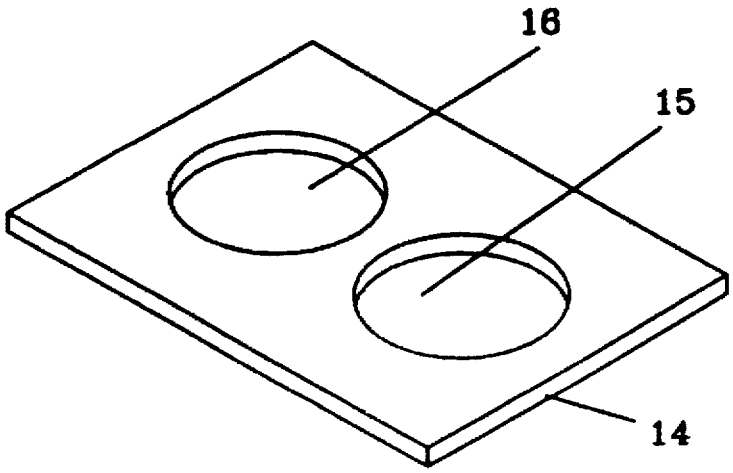
FIG. 3 shows a pair of circular mask openings.

FIG. 3 shows another embodiment of a mask in which there are to be two deposition areas. Mask 14 is positioned and indexed into a desired position by index pins 11 (FIGS. 1 and 2) to exactly position apertures 15 and 16 in a desired position over substrate 10.

Figure 4:
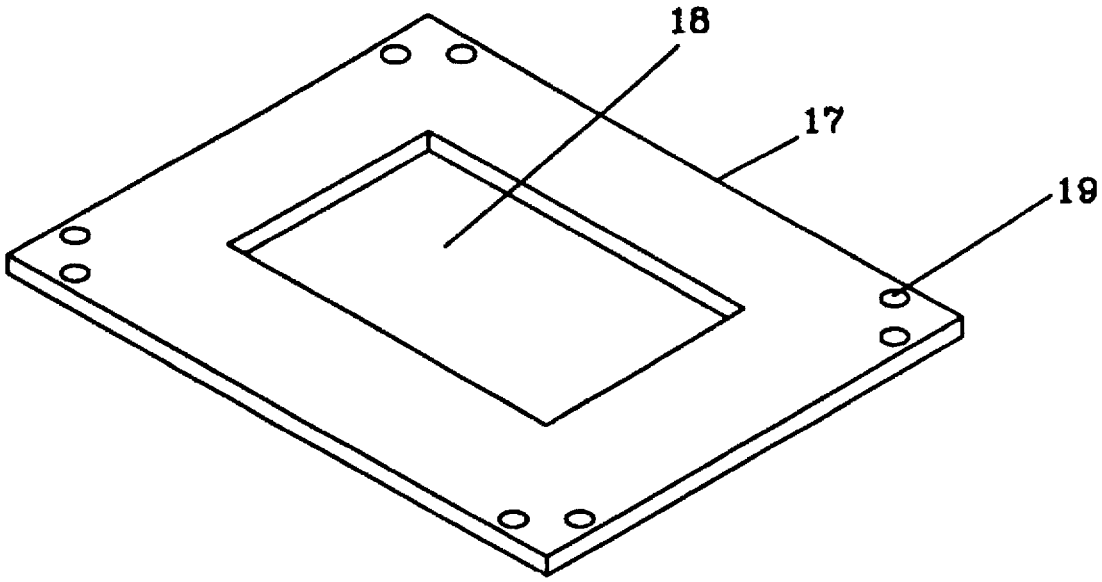
FIG. 4 shows a rectangular mask with index holes extending through the mask.

FIG. 4 is another embodiment of a mask in which an aperture in mask 17 is positioned in an exact position by index pins 11. In this embodiment, index pins 11 extend through index holes 19 in mask 17 to exactly position mask 17, and aperture 18, over a substrate.

Figure 5:
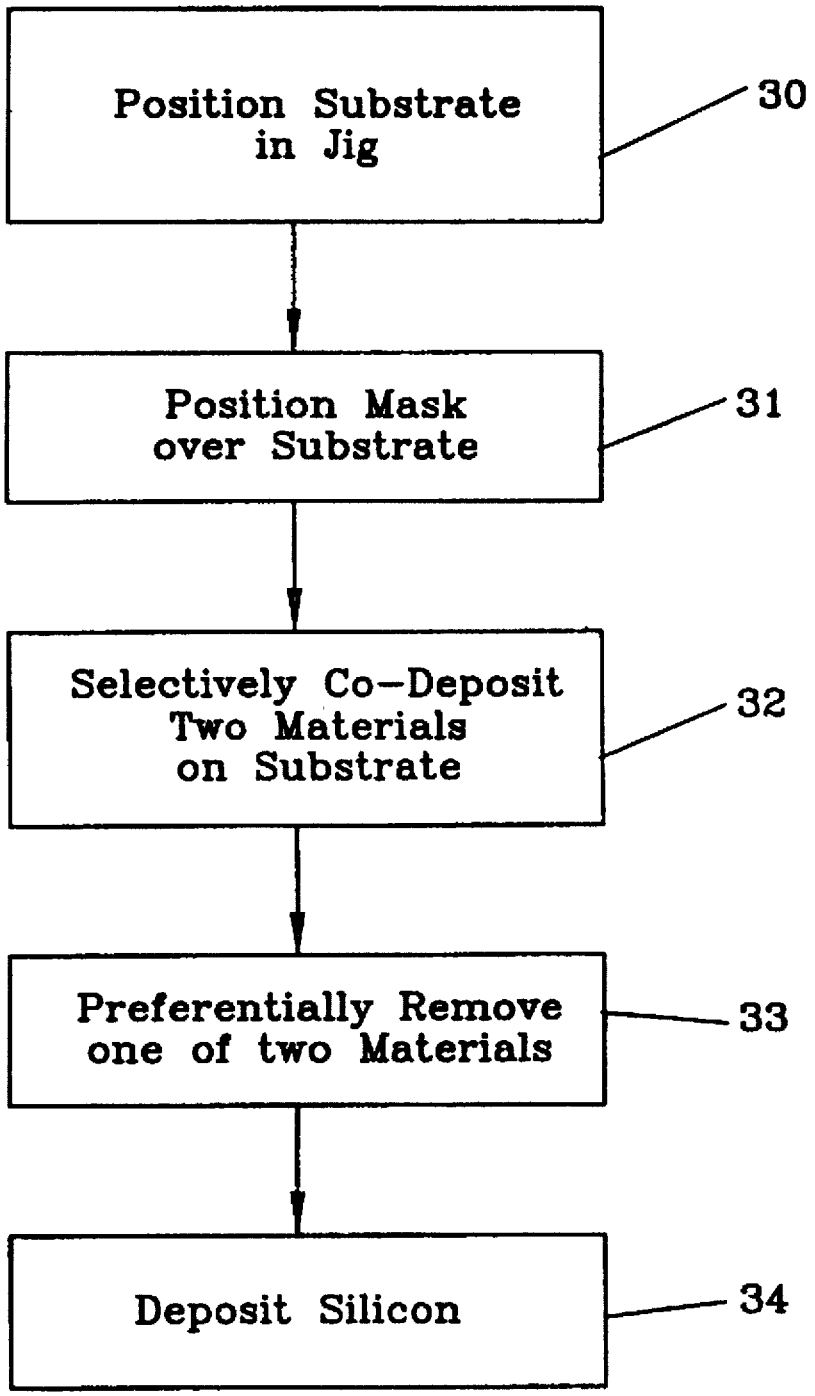
FIG. 5 is a flow diagram showing the process of the method of the invention.

FIG. 5 is a flow diagram showing the process of the method of the invention. References are herein made to reference numbers of FIGS. 1 and 2. A substrate 10 is fixed in position in a fixture (Step 30) and a mask 12 with at least one window or aperture 13 is located over substrate 10 in a precise position with index pins (Step 31). Mask 12 may be of metal, glass, plastic or similar material.

At least two materials are deposited through aperture 13 onto substrate 10. The two materials, which are dissimilar materials, are selectively co-deposited on substrate 10 (Step 32). The two materials are dissimilar in that one of the deposited materials may be removed without removing the other. The deposition of the two materials is by plasma spraying a particulate powder of the materials. This is accomplished by introducing into the plasma a mixture of powders of the two materials. By way of example, two suitable materials may be nickel and aluminum. The powders of nickel and aluminum are introduced into the plasma and are deposited onto the substrate.

In Step 33, one of the materials, for example aluminum, is removed, leaving the nickel. The aluminum can be removed by leaching, electrochemical dissolution, corrosion, combustion, or by any other suitable means. For example, the coated substrate can be subjected to an aqueous solution of a strong caustic solution such as NaOH. The aluminum is dissolved and the remaining coating is a highly porous nickel. Pore size, surface area and pore structure are controlled by controlling the relative size of the powers, the relative feed rate of the powders, and either the physical or chemical properties of the feed powders. In a typical example, the aluminum would have, for example, a powder size of 5 to 50 microns, the nickel would have a powder size of 5 to 50 microns. However, the powder size is not limited to this range.

This process produces a high surface metal or metallized substrate which is prepared by plasma deposition on a base substrate. The high surface area substrate can be subsequently coated with silicon to form a high surface area solar cell (Step 34).

Figure 6:
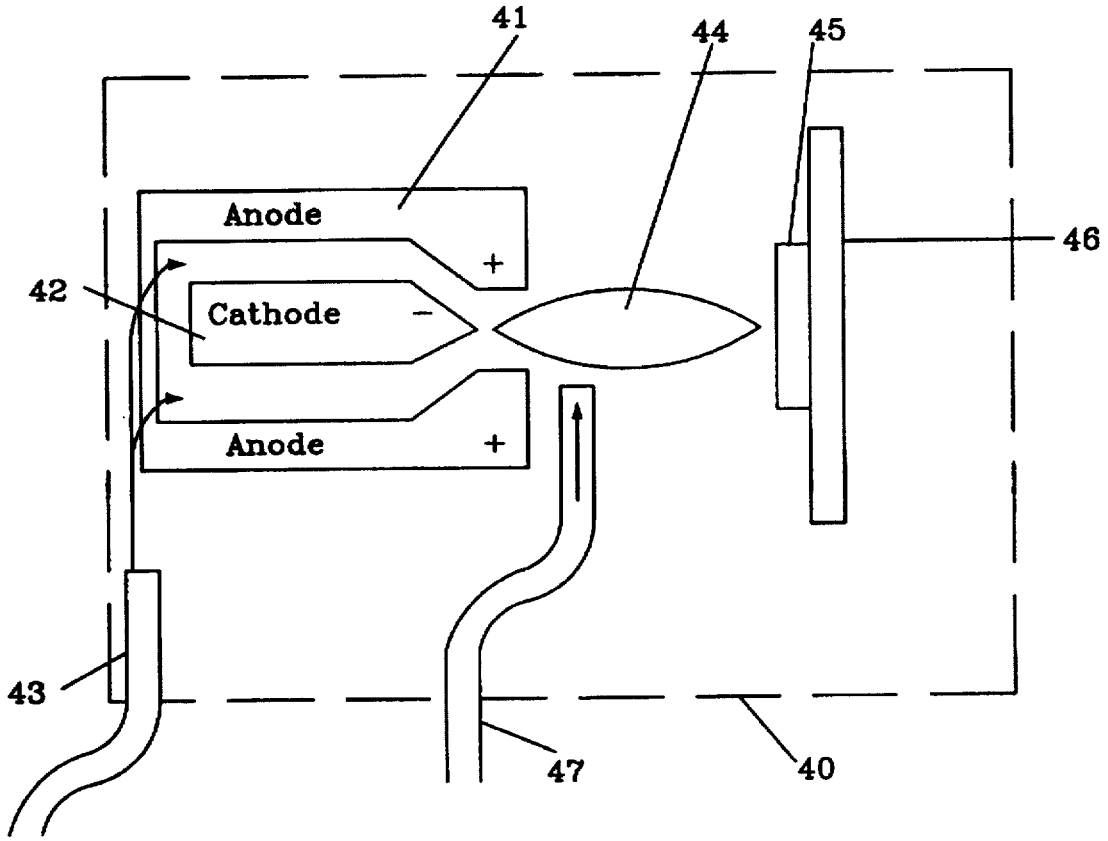
FIG. 6 is a pictorial representation of a plasma reactor.

FIG. 6 is a pictorial representation of a plasma reactor which can be used in the process of the present invention. Reactor 40 includes an anode 41 around a cathode 42. Gas is introduced in inlet 43 and directed through the anode/cathode assembly 41/42 to produce the plasma flame 44 which is directed at a substrate 46 on a mounting plate 46. Powders of the metals to be deposited are introduced in to the reactor 40 at inlet 47. Alternately, two feed tubes (47) can be used to feed powders separately. The metallic powders are directed into the plasma flame 44 and deposited on the surface of substrate 45. Subsequently, after one of the deposited metal has been removed from substrate 45, a silicon gas, such as silane, can be introduced into inlet 47 to deposit silicon on substrate 45.

What is claimed:

1. A method for forming a coating on a substrate, comprising the steps of:

positioning a mask over a substrate to define a deposition area;

simultaneously depositing dissimilar materials onto the deposition area to form a coating;

selectively removing one of the dissimilar materials to increase the surface area of the coating; and depositing a layer of silicon over the coating.

2. The method according to claim 1, wherein the dissimilar materials are plasma sprayed onto the substrate.

3. The method according to claim 2, wherein the dissimilar materials are introduced into the plasma in powder form.

4. The method according to claim 2, wherein the materials are in particulate form with the particles having a powder size in the range of 5 to 50 microns.

5. The method according to claim 1, wherein the two materials are aluminum and nickel.

6. The method according to claim 5, wherein the aluminum is preferentially removed.

7. The method according to claim 1, wherein one of the materials is removed by one of leaching, electrochemical dissolution, corrosion and combustion.

* * * * *